United States Patent [19]

Suzuki

[11] Patent Number: 4,886,148

[45] Date of Patent: Dec. 12, 1989

[54] SLIDING EXHAUST BRAKE HAVING MAIN VALVE AND AUXILIARY VALVE WITH FLOW SPACE THEREBETWEEN

[75] Inventor: Ryoichi Suzuki, Mishima, Japan

[73] Assignee: Usui Kokusai Sangyo Kaisha Ltd., Nagasawa, Japan

[21] Appl. No.: 269,495

[22] Filed: Nov. 10, 1988

[30] Foreign Application Priority Data

Nov. 18, 1987 [JP]. Japan ..... 62-176174

[51] Int. Cl.[4] ..... F02D 9/06

[52] U.S. Cl. ..... 188/273; 137/630.12; 123/323

[58] Field of Search ..... 188/154, 273; 123/323, 123/589; 137/630.12, 630.14, 630.15; 251/84–86, 326, 117

[56] References Cited

U.S. PATENT DOCUMENTS

| | | | |
|---|---|---|---|
| 4,205,704 | 6/1980 | Benson | 137/630.12 |
| 4,669,585 | 6/1987 | Harris | 123/323 X |
| 4,671,489 | 6/1987 | Jankovic | 251/327 |
| 4,685,544 | 8/1987 | Takigawa et al. | 188/273 |
| 4,733,687 | 3/1988 | Takigawa et al. | 188/273 X |
| 4,751,987 | 6/1988 | Takigawa et al. | 188/273 |

FOREIGN PATENT DOCUMENTS 14098 of 1891 United Kingdom .

*Primary Examiner*—Robert J. Oberleitner

*Attorney, Agent, or Firm*—Anthony J. Casella; Gerald E. Hespos

[57] ABSTRACT

A sliding exhaust brake includes a housing of an exhaust brake body having an exhaust passage with an exhaust pipe provided projectingly on opposite end portions thereof. A platelike valve member with an exhaust pressure regulating hold perforated through its bottom wall surface is installed within a reciprocating way communicating with the exhaust passage. An air cylinder is provided on an upper side end portion of the reciprocating way, and an auxiliary valve member is fitted on a nose portion of a piston rod of the air cylinder passing through a dissepiment with the air cylinder. For closing the exhaust passage, the exhaust pressure regulating hole is closed by the auxiliary valve member from engaging end edge portions of salient walls provided on the nose portion of the auxiliary valve member with the platelike valve member intermediately thereof to push in one direction. For opening, the end edge portions are separated therefrom and slide on the surface of the platelike valve member to disclose the exhaust pressure regulating hole.

6 Claims, 2 Drawing Sheets

SLIDING EXHAUST BRAKE HAVING MAIN VALVE AND AUXILIARY VALVE WITH FLOW SPACE THEREBETWEEN

BACKGROUND OF THE INVENTION

1. Field of the Invention

The present invention relates to a structural improvement of a valve mechanism in a sliding exhaust brake provided halfway of an exhaust pipe generally in a large-sized automobile such as truck, bus or the like, blocking a passage of exhaust gas flowing in the exhaust pipe at the time of steep downward slope, thereby providing a braking effect to the automobile.

2. Description of the Prior Art

As exemplified in FIG. 7, a valve mechanism of a prior art exhaust brake of this kind is structured such that an exhaust pressure regulating hole (24) provided through the surface of a platelike valve member (23) installed in a reciprocating way within a housing of the body is slit in the cross direction, a block member (25) fixed near the nose of a piston rod (26) and engaging with the valve member (23) operates correlatively with an auxiliary valve member (27) with a liner (28) rectangular to the aforementioned slit to slide on the surface of the valve member (23) fitted loosely and so laid on the lower surface of the block member, and an exhaust passage is operated through pushing and lifting by impact and engagement on a side of the valve member (23) at a nose portion of the piston rod (26) and a side wall surface of the block member (25). Then, (29) denotes a small-diametral exhaust vent for prevention of overload to an engine side when the exhaust passage is kept close.

However, as a structure of the aforementioned auxiliary valve member, since restrictions are placed inevitably on a size of the exhaust pressure regulating hole (24) relatively to that of the valve member (23) in a limited space, a sufficient exhaust pressure drop is not obtainable in advance to opening, and the engaging construction by impact for operating the passage is capable of causing wear or rattle on a mutual contact portion, and an actuation repeated so frequently at the time of service may shorten a lifetime of products and thus deteriorate a long durability.

SUMMARY OF THE INVENTION

An object of the invention is to provide a sliding exhaust brake capable of realizing a sufficient exhaust pressure drop to a smooth and quick function at the exhaust pressure regulating hole in advance to an opening of the aforementioned valve mechanism, thereby preventing wear or rattle from arising on a mutual contact portion to a long durability.

In an exhaust brake wherein a plate-like valve member with an exhaust pressure regulating hole perforated through the surface is installed in a reciprocating way of a housing of an exhaust brake body with which the reciprocating way of the plate-like valve member communicates in the direction substantially rectangular to an exhaust passage with coupling walls to an exhaust pipe provided projectingly on opposite side end portions, an auxiliary valve member is provided on the nose portion of a piston rod passing through a dissepiment with an air cylinder provided on an upper side end portion of the reciprocating way, and is engaged with the valve member, the exhaust pressure regulating hole is closed by the auxiliary valve member and the valve member is pushed in one direction on the nose portion of the piston rod when the exhaust passage is closed by the valve member, then the exhaust pressure regulating hole is opened by the auxiliary valve member for opening and the auxiliary valve member is engaged with the valve member to shift in the other direction at the same time, the invention provides an improvement that an upward salient wall projecting ahead and a pair of sideward salient walls are provided on a nose portion of the auxiliary valve member, a flow space surrounded by the salient walls is formed, a rear end wall portion of the auxiliary valve member is provided near a nose of the piston rod to an integral moving structure, end edge portions of the salient walls are pressed to an intermediate beam wall portion on the valve member side and so pushed in one direction so as to block the exhaust pressure regulating hole with the auxiliary valve member at the time of closing, while the end edge portion is separated from the intermediate beam wall portion to uncover and thereby open the hole and slide on the surface of the valve member at the time of opening, thus realizing a dual valve structure.

As described above, the sliding exhaust brake according to the invention is capable of ensuring an exhaust pressure drop to the full extent to smooth and accelerate the function by the exhaust pressure regulating hole which can easily be enlarged as far as a position of the flow space despite a size of the valve member in a limited space according to the upward salient wall and the pair of sideward salient walls provided on the nose portion of the auxiliary valve member, the flow space surrounded by the salient walls and the structure moving integrally on the nose portion of the piston rod, and on the other hand, the aforementioned integral moving structure and a sliding bottom structure of the auxiliary valve member capable of enlarging a pressure area at the end edge portion by the salient walls are effective in preventing or lessening wear or rattle between these members to ensure a durability for a long period of time, thus providing a very useful sliding exhaust brake.

DETAILED DESCRIPTION OF PREFERRED EMBODIMENTS

Figure 3:
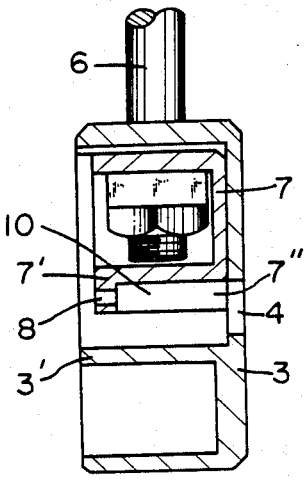
FIG. 3 is a sectional view taken on line A—A of FIG. 2.
Figure 4:
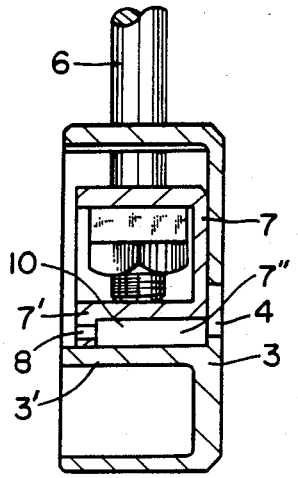
FIG. 4 is an explanatory drawing of the valve mechanism of FIG. 3 in close state.
Figure 5:
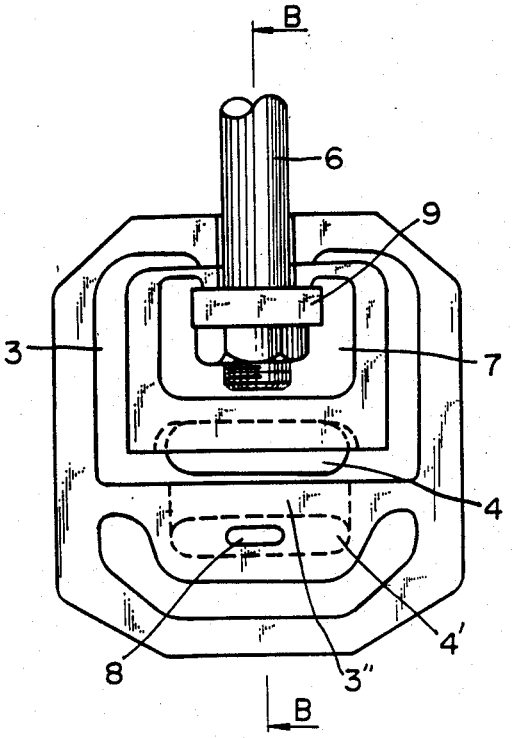
FIG. 5 is an enlarged plan view of another embodiment of the invention.
Figure 7:
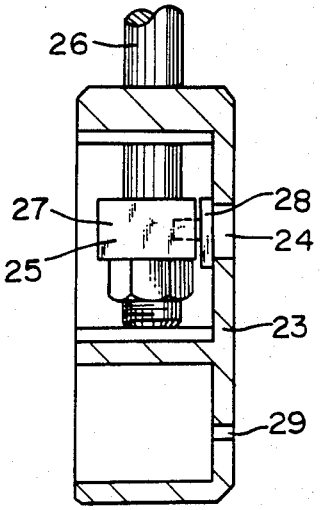
Fig. 7 PRIOR ART
FIG. 7 is a longitudinal sectional view showing a part of prior art valve mechanism.
Figure 6:
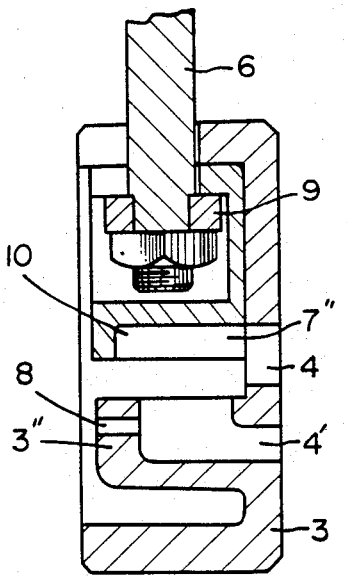
FIG. 6 is a sectional view taken on line B—B of FIG. 5.

In FIG. 1 to FIG. 6, (1) denotes a housing of an exhaust brake body with which a reciprocating way of a plate-like valve member (3) communicates in the direction almost rectangular to an exhaust passage (2) with a coupling wall (1') to an exhaust pipe provided projectingly on opposite side end portions, and the valve member (3) installed within the reciprocating way of the housing has an exhaust pressure regulating hole (4) perforated through its bottom wall surface side wall of the valve member 3 is engaged near a nose of a piston rod (6) passing through a dissepiment of an air cylinder (5) provided on an upper side end portion of the reciprocating way. A reference numeral (7) denotes an auxiliary valve member superposed on the valve member (3), which is provided near a nose of the piston rod through a lock member (9) from the engaging portion of the piston rod (6) toward the nose portion almost without a play to move integrally. Then, an upward salient wall (7') projecting ahead and a pair of sideward salient walls (7", 7") are provided on its nose portion, a flow space (10) surrounded by the salient walls (7', 7", 7") is formed, the flow space (10) communicates with the exhaust pressure regulating hole (4) when the exhaust pressure regulating hole (4) is kept open, and when the exhaust pressure regulating hole is closed, end edge portions of the salient walls (7', 7", 7") are pressed to engage with an intermediate beam wall (3') on the valve member (3) side and push it downward so as to block the exhaust pressure regulating hole (4) on the auxiliary valve member, and for opening, the end edge portions are separated from the intermediate beam wall (3') to disclose the hole and lift. Then, in the illustrated embodiment, the exhaust pressure regulating hole (4) is blocked half at the bottom of the auxiliary valve member (7), however, if the exhaust pressure regulating hole (4) portion is covered with the salient walls (7', 7", 7") to interrupt an exhaust gas flow, the exhaust pressure regulating hole (4) need not be blocked by the aforementioned bottom. A reference numeral (8) denotes an exhaust vent with a small diameter provided on the surface of the salient wall (7') for prevention of overload to an engine side at the time of closing Then, as shown in FIG. 5 and FIG. 6, a nose portion (3") of the intermediate beam wall (3') with which the salient walls (7', 7", 7") are engaged to press will be thickened, according to a design, and a bypass regulating hole (4') will be perforated to open halfway of the exhaust pressure regulating hole (4), thereby enlarging further an area of the exhaust pressure regulating hole, and there may be a case where both the exhaust pressure regulating hole (4) and the bypass regulating hole (4') will be constructed into one hold.

Figure 1:
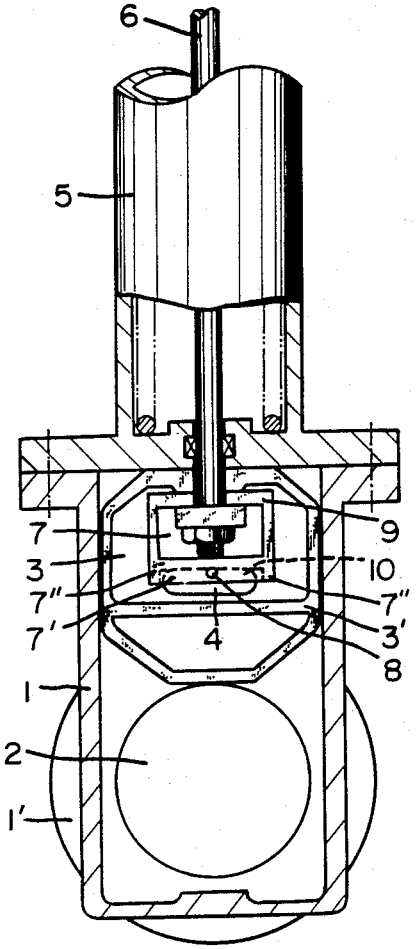
FIG. 1 is a plan view, partly cutaway, showing a sliding exhaust brake given in one embodiment of the invention.
Figure 2:
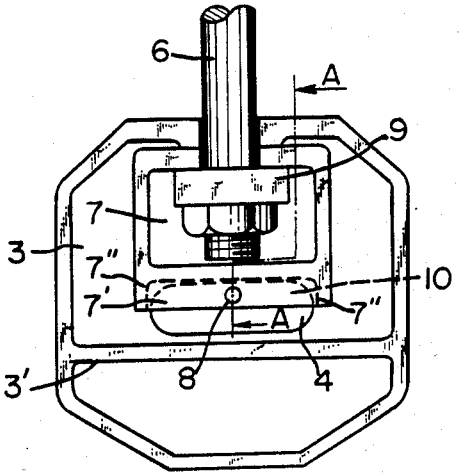
FIG. 2 is an enlarged plan view showing a valve mechanism in open state which relates to a main part of the invention of FIG. 1.

Since the invention is constructed as above, the valve member (3) is pushed downward to closing on end edge portions of the salient walls (7', 7", 7") of the auxiliary valve member with the exhaust pressure regulating hole (4) blocked by sliding of the auxiliary valve member (7) on the valve member surface, as shown in FIG. 4, and on the other hand, as shown in FIG. 2 and FIG. 3 for opening, the valve member (3) is lifted by the side wall surface on the block member (9) side through the auxiliary valve member with the exhaust pressure regulating hole (4) disclosed by separation of the end edge portions from the intermediate beam wall (3') according to the auxiliary valve member (7), and in such operating state, the exhaust pressure regulating hole (4) can be enlarged as far as a position of the flow space even in a space at the limited surface on the valve member (3) side from having the exhaust pressure regulating hole communicate with the flow space (10) surrounded by the salient walls (7', 7", 7"), superposed further thereon, and is fitted almost without a play on the auxiliary valve member (7) with a sufficient sliding bottom surface and the nose of the piston rod (6), thus moving integrally with the piston rod for opening and closing operations.

What is claimed is:

1. A sliding exhaust brake comprising:

a housing having an exhaust passage extending therethrough and a reciprocating way communicating with the exhaust passage and angularly aligned thereto;

a cylinder assembly mounted in proximity to said housing, said cylinder assembly including a piston rod having an end disposed in said reciprocating way for alternate reciprocal movement toward and away from the exhaust passage;

a plate-like valve member mounted to said piston rod for limited relative movement thereto, said plate-like valve member being movably disposed in said reciprocating way from a first position for blocking said exhaust passage, to a second position for opening said exhaust passage, said plate-like valve member comprising a bottom wall extending generally transverse to the exhaust passage for substantially blocking the exhaust passage in the first position of said plate-like valve, a beam wall extending from said bottom wall and aligned generally transverse to the piston rod, a side wall extending from said bottom wall and disposed intermediate the end of the piston rod and the cylinder assembly, said bottom wall having an exhaust pressure regulating hole extending therethrough at a location thereon in proximity to said beam wall; and an auxiliary valve member movably disposed in proximity to said bottom wall of said plate-like valve member and intermediate the beam wall and the side wall thereof, said auxiliary valve member comprising a main body portion securely mounted to said piston rod and a salient wall portion extending away from said main body portion and said piston rod and toward the beam wall of said plate-like valve member, such that said salient wall portion defines a flow space relative to said main body portion and said plate-like valve member, said salient wall portion being dimensioned to engage the beam wall in response to movement of the piston rod out of the cylinder assembly for urging the plate-like valve member into the first position and substantially blocking the exhaust pressure regulating hole, said salient wall portion being movable away from said beam wall in response to a movement of the piston rod into the cylinder assembly for opening the exhaust pressure regulating hole, whereby continued movement of the piston rod into the cylinder assembly urges said plate-like valve member into the second position.

2. A sliding exhaust brake as in claim 1 wherein the plate-like valve member further includes a bypass regulating hole extending through the bottom wall to communicate with the flow space defined by the salient wall portion of the auxiliary valve, whereby the exhaust pressure regulating hole and the bypass regulating hole provide increased exhaust gas flow into the flow space defined by the salient wall portion of the auxiliary valve.

3. A sliding exhaust brake as in claim 2 wherein the plate-like valve member further comprises and exhaust vent extending therethrough and communicating with the bypass regulating hole for preventing overload of exhaust gas pressure when the plate-like valve member is in the second position.

4. A sliding exhaust brake as in claim 1 wherein the salient wall portion of the auxiliary valve member comprises an exhaust vent extending therethrough for preventing overload of exhaust gas pressure in the second position of the plate-like valve member.

5. A sliding exhaust brake as in claim 1 wherein the salient wall portion of the auxiliary valve member comprises a first salient wall extending generally parallel to the bottom wall of the plate-like valve member and a pair of spaced apart side salient walls extending integrally from the first salient wall and generally in sliding contact with the bottom wall of the plate-like valve member.

6. A sliding exhaust brake as in claim 1 wherein the main portion of the auxiliary valve member is dimensioned for being urged into the side wall of the plate-like valve member in response to movement of the piston rod into the cylinder assembly for urging the plate-like valve member into the second relative position thereof.

* * * * *